United States Patent [19]

Schillinger

[11] Patent Number: 4,513,863

[45] Date of Patent: Apr. 30, 1985

[54] FLIP TOP DISPENSER CARTON

[75] Inventor: Joseph F. Schillinger, Fulton, Ill.

[73] Assignee: Champion International Corporation, Stamford, Conn.

[21] Appl. No.: 552,926

[22] Filed: Nov. 18, 1983

[51] Int. Cl.[3] ..... B65D 85/10; B65D 85/12

[52] U.S. Cl. ..... 206/264; 206/268; 206/273; 229/44 CB

[58] Field of Search ..... 206/273, 268, 264; 229/44 R, 44 CB, 17 R

[56] References Cited

U.S. PATENT DOCUMENTS

| | | | |
|---|---|---|---|
| 1,907,067 | 5/1933 | Hartmann | 206/273 |
| 2,265,828 | 12/1941 | Wilson | 206/268 |
| 2,339,656 | 1/1944 | Shina | 206/268 |
| 2,848,152 | 8/1958 | Geiger, Sr. | 229/44 CB |
| 2,940,590 | 6/1960 | Hook | 206/268 |
| 2,958,418 | 11/1960 | Gorman | 206/268 |
| 3,282,465 | 11/1966 | Davis | 206/268 |
| 4,372,443 | 2/1983 | Woo Seop | 206/268 |

*Primary Examiner*—Joseph Man-Fu Moy

*Attorney, Agent, or Firm*—Evelyn M. Sommer; William W. Jones

[57] ABSTRACT

The subject carton is adapted for dispensing of its contents through an opening in the top of the carton. The opening is opened and closed by a pivotable flip top closure which is hinged to the top of the carton so as to allow product to be poured out of the carton through the opening. The opening is located at a top side portion of the carton.

6 Claims, 6 Drawing Figures

FLIP TOP DISPENSER CARTON

This invention relates to a carton for dispensing product through an opening formed in the top of the carton. The opening is opened and closed by means of a flip top pivoting closure hingedly connected to the top wall of the carton.

Paperboard cartons adapted for dispensing of product via an opening in the top of the carton which is covered and uncovered by a pivotable flip top are generally old in the art. Some typical constructions for such cartons are shown in U.S. Pat. Nos. 2,348,377 Goodyear; 2,351,812 Guyer; 2,355,665 Mabee; 2,361,597 Buttery; 3,033,435 Forrer; 3,335,924 Miller; 3,338,502 Sabin; and 3,765,593 D'Alessio.

The carton of this invention has a pivotable flip top closure which is hingedly connected to the top wall assembly of the carton. The top closure has side wing panels, one of which is integral with the front wall of the carton and the other of which overlaps the back wall of the carton. The wing panels are foldably interconnected by an outer panel which overlies a side wall of the carton. The top wall of the flip top closure is formed by overlapping closure flaps foldably connected respectively to the front wall, the back wall, and the outer panel, which overlapping closure flaps are adhesively secured together. The front wing panel is connected to the front panel by a rupturable interrupted cut score line which serves to hold the flip top closure in its closed position prior to initially opening the carton. To open the carton, the outer panel is moved upwardly causing the cut score line to rupture whereby the closure is free to pivot to a carton-opening position. The closure can then be pivoted back down to re-close the carton.

It is, therefore, an object of this invention to provide a paperboard carton formed from a one-piece blank, which carton has a pivoting flip top closure.

It is a further object of this invention to provide a carton of the character described wherein the closure is initially secured to a wall of the carton by a rupturable interrupted cut score line.

It is an additional object of this invention to provide a carton of the character described wherein the closure includes panels thereof which overlie respective walls of the carton.

These and other objects and advantages of the carton of this invention will become more readily apparent from the following detailed description of a preferred embodiment thereof taken in conjunction with the accompanying drawings, in which.

Figure 1:
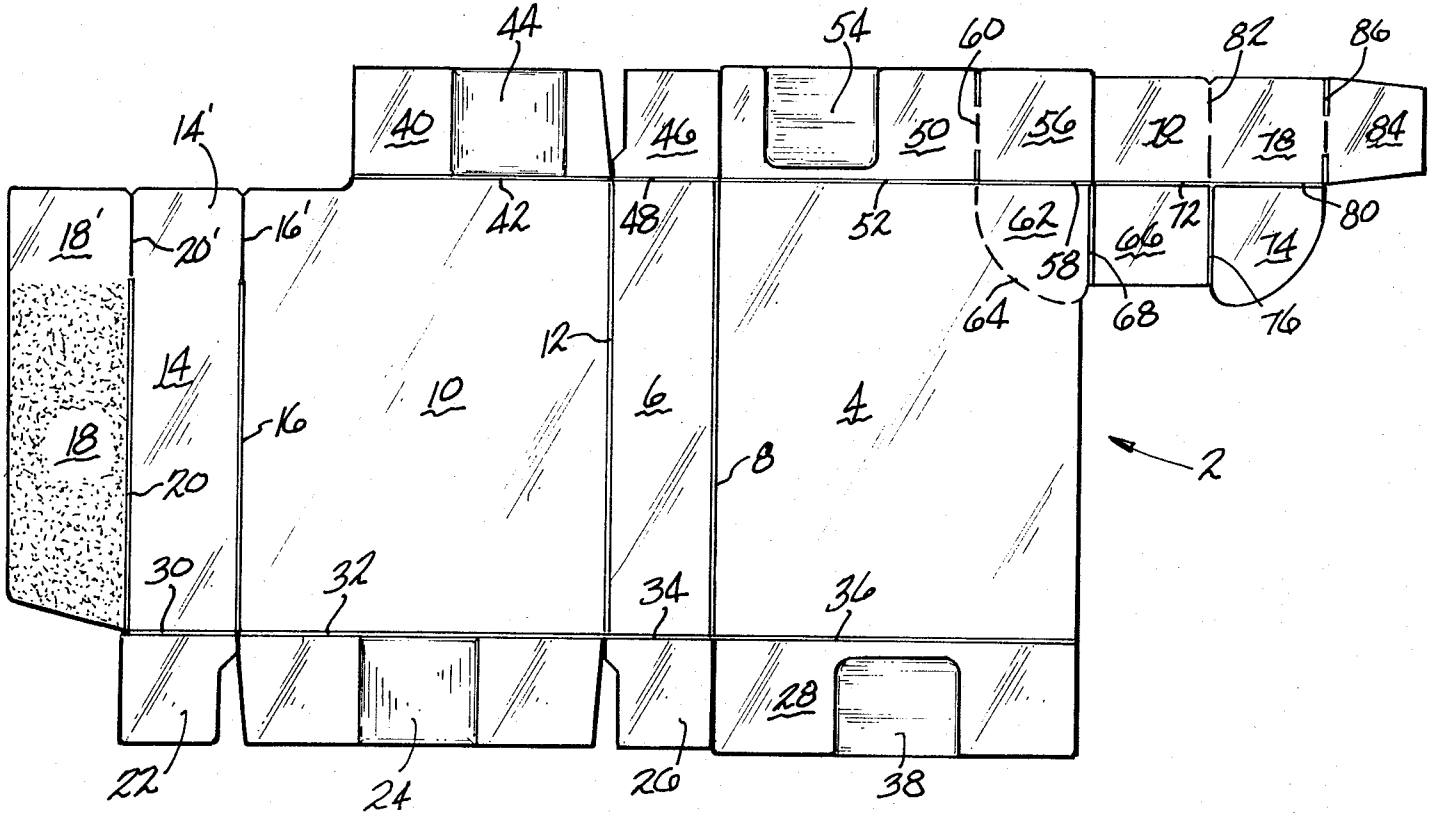
FIG. 1 is a plan view of a preferred embodiment of a cut scored paperboard blank from which the carton of this invention is formed, the outside surface of the blank facing the viewer.

Referring now to the drawings, there is shown in FIG. 1 a preferred embodiment of a one-piece cut scored paperboard blank, denoted generally by the numeral 2, which is adapted to form the carton of this invention. The blank 2 includes a front wall panel 4, a first side wall panel 6 connected to the front wall panel 4 along a fold line 8, and a back wall panel 10 connected to the side wall panel 6 along a fold line 12. A second side wall panel 14 is connected to the back wall panel 10 along a fold line 16, and a glue flap 18 is connected to the second side wall panel 14 along a fold line 20. The stippling on the glue flap 18 indicates generally the placement of adhesive on the glue flap 18. It is noted that the upper portion 18' of the glue flap 18 is devoid of adhesive. It is also noted that the upper portions adjacent to the fold lines 16 and 20 are cut at 16' and 20' to give flexibility to the upper portion 14' of the side wall panel 14.

Bottom closure flaps 22, 24, 26 and 28 are foldably connected to the panels 14, 10, 6 and 4 along fold lines 30, 32, 34 and 36 respectively. The flap 28 has an embossed area 38 thereon which is raised toward the viewer, as shown in FIG. 1. This allows for closer contact between the flaps when the bottom is formed on the carton.

The top closure of the carton is formed by a plurality of closure flaps which are folded into overlapping relationship. The top closure flaps include a flap 40 foldably connected to the top of the back wall panel 10 along a fold line 42. The flap 40 is embossed at 44 so as to be raised toward the viewer as seen in FIG. 1. A top closure flap 46 is connected to the top of the side wall panel 6, along a fold line 48. A third top closure flap 50 is connected to the top of the front wall panel 4 along a fold line 52. The closure flap 50 is embossed at 54 so as to be recessed away from the viewer as seen in FIG. 1. A pivoting closure panel 56 is foldably connected to the top edge of the front wall panel 4 along a fold line 58 and is also pivotably connected to the closure flap 50 along a fold line 60. It will be noted that the closure panel 56 is connected by the fold line 58 to a portion 62 of the front wall panel 4 which is bounded by a rupturable interrupted cut score line 64, which portion 62 forms a wing panel for the closure assembly of the carton. The wing panel 62 is foldably connected to an outer end closure panel 66 by a fold line 68. The closure panel 66, in turn, is foldably connected to an inner top closure flap 70 by a fold line 72, and to a second wing panel 74 by a fold line 76. The second wing panel 74 is foldably connected to a medial top closure flap 78 along a fold line 80. The medial top closure flap 78 is foldably connected to the inner top closure flap 70 along a rupturable cut score line 82, and to a second medial top closure flap 84 along a fold line 86. The reverse surface of the closure flap 84 is coated with an adhesive layer.

Figure 3:
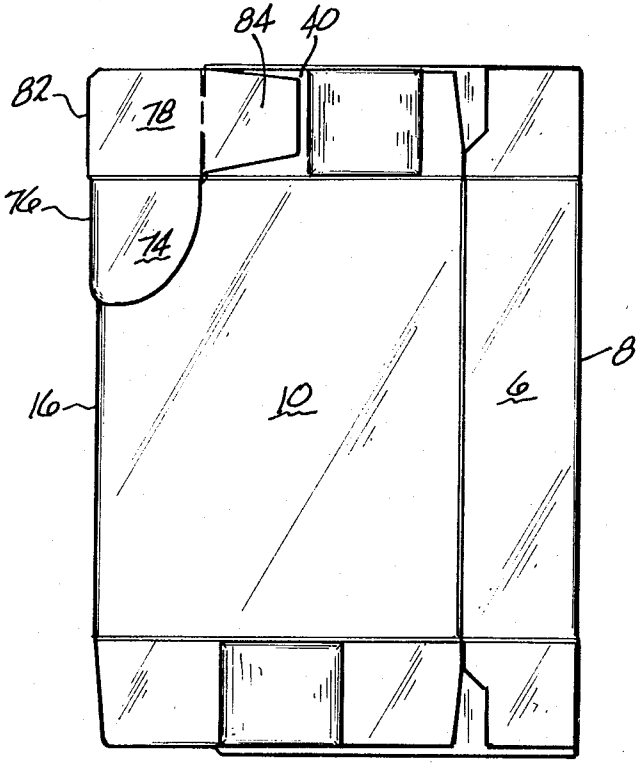
FIG. 3 is a plan view similar to FIG. 2 but showing the back wall of the carton.
Figure 2:
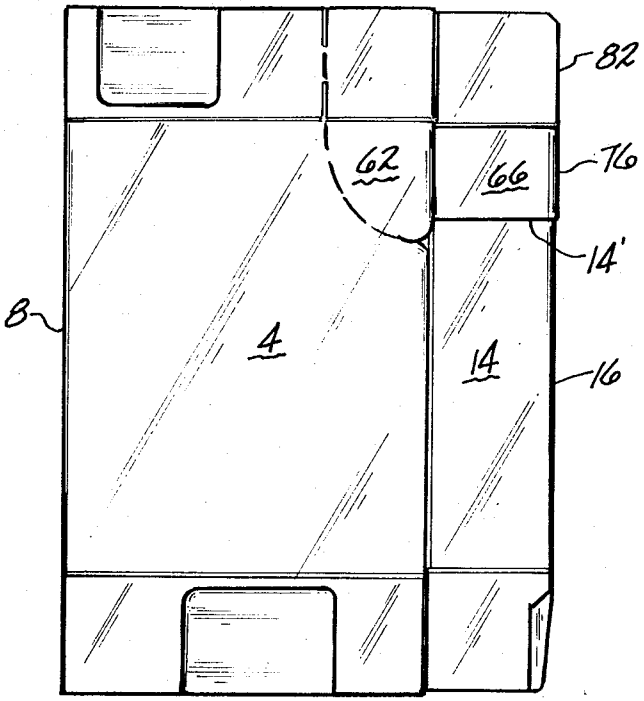
FIG. 2 is a plan view of the flattened bulk shipping form of the carton showing the front wall of the carton.

In order to form the flattened bulk shipping form of the carton shown in FIGS. 2 and 3, the blank 2 is folded about the fold line 16 and the fold line 8 to bring the adhesive coated surface of the panel 18 into contact with the inner surface of the front wall panel 4. The wing panel 74 and medial top closure flap 78 are folded about the fold lines 76 and 82 to bring the adhesive coated surface of the flap 84 into contact with the top closure flap 40. The folding of the fold line 82 causes rupture of the latter whereby the flap 78 is then free of connection to the flap 70. As noted in FIGS. 2 and 3, the outer side closure panel 66 overlies the upper portion 14' of the side wall panel 14, and the wing panel 74 overlies the back wall panel 10.

Figure 4:
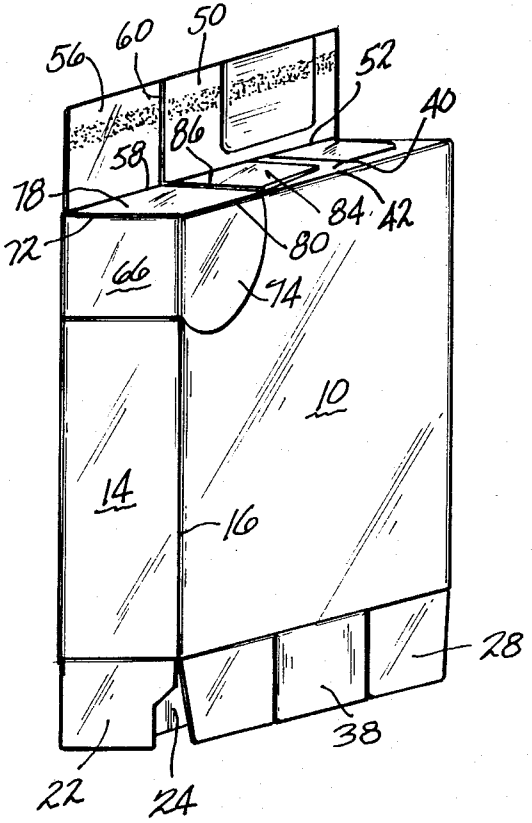
FIG. 4 is a perspective view of the partially erected carton showing the manner in which the flip top closure is formed prior to folding the outermost top closure flap into place.

The carton is further erected to the expanded form shown in FIG. 4 by applying compression to the fold lines 8 and 16 to cause the side panels 6 and 14 to orient perpendicular to the front and back panels 4 and 10. This also orients the outer side closure panel 66 perpendicular to the wing panels 62 and 74. The side inner top closure flaps 46 and 70 are then folded about the fold lines 48 and 72 respectively to lie perpendicular to the side wall panels 6 and 14 with the flap 70 also lying perpendicular to the outer side closure panel 66. The coadhered panels 40, 78 and 84 are then folded inwardly about the fold lines 42 and 80 respectively into overlapping relationship with the flaps 46 and 70 and secured thereto. The outer top closure flaps 50 and 56 are then folded inwardly about the fold lines 52 and 58 respectively into overlapping relationship with the flaps 40, 84 and 78 and secured thereto. The latter folding operation brings the fold lines 60 and 86 into overlying registry. The top of the carton is thus closed whereupon the carton is then filled with product through the open bottom which is thereafter closed.

Figure 5:
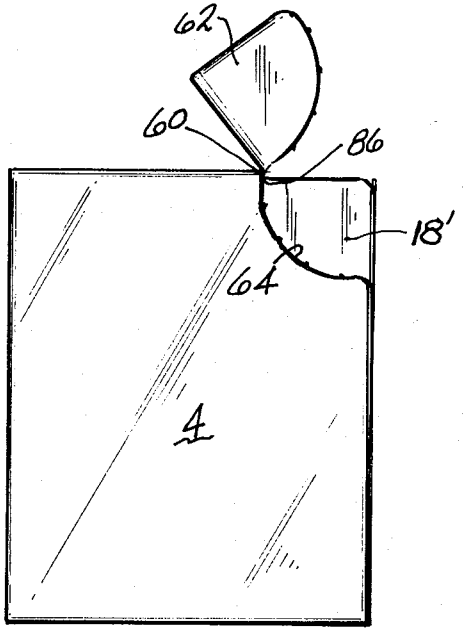
FIG. 5 is a front side elevational view of the erected carton showing the top closure pivoted to its open position.
Figure 6:
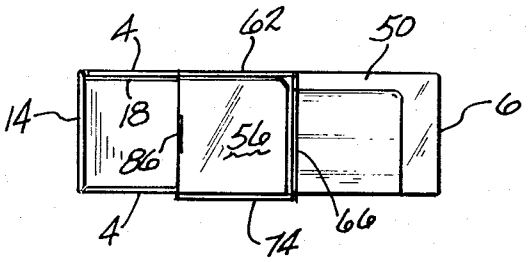
FIG. 6 is a top plan view of the erected carton showing the top closure pivoted to its open position.

To open the filled carton, the outer top closure panel 66 is pulled upwardly from the underlying side wall panel 14 causing the rupturable interrupted cut score line 64 to break freeing the wing panel 62 from connection with the front wall panel 4. The closure panels 56, 62, 66, 70, 74 and 78 then pivot about the superimposed fold lines 60 and 86 to the position shown in FIG. 5. It will be noted that the absence of adhesive on the upper portion 18' of the panel 18 allows the wing 62 to move upwardly away from the front wall panel 4. Pivoted movement of the top closure may be continued until the panel 56 is brought against the panel 50, as shown in FIG. 6, whereupon the carton is opened so that its contents can be poured out through the exposed opening. The carton may be reclosed by pivoting the top closure structure about the fold lines 60 and 86 back to its initial position.

It will be readily appreciated that the carton of this invention provides a secure, yet easily openable flip top closure for dispensing of product. The carton can be readily erected from the blank to a flattened bulk shipping configuration, and further erected from the flattened configuration to an expanded form. The connection between one of the wing panels and its associated front wall panel permits ready observation of tampering of the closure assembly.

Since many changes and variations of the disclosed embodiment of the invention may be made without departing from the inventive concept, it is not intended to limit the invention otherwise than as required by the appended claims.

What is claimed is:

1. A carton formed from a one-piece paperboard blank, said carton comprising front and back walls interconnected by opposed side walls and said carton having a pivotable top closure comprising:

(a) a pair of wing panels, one of said wing panels being connected to one of said front and back walls by a rupturable interrupted cut score line, and the other of said wing panels overlying the other of said front and back walls;

(b) an outer closure panel foldably connected to each of said wing panels, said outer closure panel overlying one of said side walls;

(c) a plurality of top closure flaps foldably connected to said wing panels and said outer closure panel, said top closure flaps being overlapped and adhesively secured together; and (d) at least one of said top closure flaps being foldably connected to a top cover flap which, in turn, is foldably connected to one of said front and back walls.

2. A carton formed from a one-piece paperboard blank, said carton having front, back and side walls foldably connected together, and said carton having a pivotable top closure comprising:

(a) a first top cover flap foldably conncted to one of said front and back walls;

(b) a first wing panel connected to one of said front and back walls along a rupturable interrupted cut score line;

(c) a second wing panel overlying the other of said front and back walls;

(d) an outer closure panel overlying one of said side walls and foldably connected to each of said wing panels;

(e) a first top closure flap foldably connected to said first wing panel;

(f) a second top closure flap foldably connected to said outer closure panel;

(g) a third top closure flap foldably connected to said second wing panel;

(h) said first, second and third top closure flaps being overlapping and adhesively secured together; and (i) at least one of said top closure flaps being foldably connected to said first top cover flap.

3. The carton of claim 2, further comprising a second top cover flap foldably connected to the other of said front and back walls with said first and second top cover flaps being overlapping and adhesively secured together.

4. The carton of claim 3, further comprising a glue flap connected to said third closure flap along a first fold line said glue flap overlapping and being adhesively secured to one of said first and second top cover flaps.

5. The carton of claim 4, wherein said first top closure flap is foldably connected to the other of said first and second top cover flaps along a second fold line and wherein said first and second fold lines are disposed in overlying registry.

6. The carton of claim 2, further comprising a glue panel foldably connected to said one of said side walls and adhesively secured to an inside surface of said one of said front and back walls, said glue panel underlying said first wing panel and being free of adhesive on the portion thereof which underlies said first wing panel.

* * * * *